US005722876A

United States Patent [19]

Mori et al.

[11] Patent Number: 5,722,876

[45] Date of Patent: Mar. 3, 1998

[54] ELECTRIC MOTOR DRIVEN TYPE ON-LINE ROLL GRINDER, ITS CONTROL METHOD AND GRINDING METHOD

[75] Inventors: Shigeru Mori, Hitachi; Toshitsugu Ohara, Jyuou-machi, both of Japan

[73] Assignee: Hitachi, Ltd., Tokyo, Japan

[21] Appl. No.: 687,992

[22] Filed: Jul. 29, 1996

[30] Foreign Application Priority Data

Jul. 27, 1995 [JP] Japan ..... 7-191439

[51] Int. Cl.[6] ..... B24B 49/00; B24B 51/00

[52] U.S. Cl. ..... 451/10; 451/14; 451/425; 451/160

[58] Field of Search ..... 451/14, 10, 49, 451/155, 156, 5, 173, 451, 424, 425, 11, 426, 160, 548; 173/217; 310/67 R, 58, 59, 87

[56] References Cited

U.S. PATENT DOCUMENTS

| | | | |
|---|---|---|---|
| 5,402,606 | 4/1995 | Helgren | 451/184 |
| 5,562,525 | 10/1996 | Mori et al. | 451/425 |
| 5,569,060 | 10/1996 | Mori et al. | 451/425 |

*Primary Examiner*—James G. Smith
*Assistant Examiner*—Derris H. Banks
*Attorney, Agent, or Firm*—Evenson McKeown Edwards & Lenahan, PLLC

[57] ABSTRACT

An electric drive motor with a small size and large rotary torque is used as a driving device for a grinding wheel of a grinding device. The motor such as an AC servo motor is encased in a casing to protect it from humidity, high temperature, scattered oil, etc. The atmosphere in the casing is controlled to protect the motor. The pressure, temperature and humidity in the casing are controlled by introducing dried air into the casing.

29 Claims, 8 Drawing Sheets

ELECTRIC MOTOR DRIVEN TYPE ON-LINE ROLL GRINDER, ITS CONTROL METHOD AND GRINDING METHOD

BACKGROUND OF THE INVENTION

1. Field of the Invention

This invention is related to an on-line roll grinder for grinding a roll provided in a rolling mill, its controlling method and a grinding method, whereby an environment of an electric motor for driving a grinding wheel is protected.

2. Description of the Prior Art

Generally, when a slab material is rolled by rolls of a rolling mill, only the rolling part of the rolls is worn so that a difference in level is caused between the rolling part and a non-rolling part. Therefore, there is a limitation of rolling that the slab should be rolled in the order of wider slabs to narrower slabs. As a means for solving this problem, an on-line roll grinder is proposed thereby to grind the rolls on-line. In Japanese Patent Laid-Open Print No 6-47654, the titled "Rolling mill provided with on-line roll grinder and on-line roll grinder", described is that the rolls are ground by using a driving motor for a grinding wheel having a rotary grinding wheel. By using a hydraulic motor as a driving unit for rotating the grinding wheel, the size of the motor can be made small, and the required grinding torque can be easily generated. By controlling the quantity of the oil supply, the rotary speed of the motor can be controlled, too. In Japanese Patent Laid-Open Print No 6-270059, described is a grinding standard level detector of a grinding robot that detects a grinding standard level accurately by installing a servo motor composed of an encoder in the transfer mechanism of the grinding wheel for moving the grinding wheel to the grinding level in order to detect the position of the grinding wheel, without using an external detector.

There are the following problems in the above prior art. In the technology disclosed in Japanese Patent Laid-Open Print No 6-47654, the on-line grinder grinds while the hydraulic motor moves in the axial direction of the roll together with the grinding wheel. Thus, it is generally necessary to install pipings from the places of a pump, etc. to rotate the hydraulic motor and to supply a high pressure oil to the hydraulic motor by using a flexible hose in the rolling mill. Therefore, in the case where the flexible hose for supplying the high pressure oil is broken by a rolling fault, there is a problem of the safety in that the oil is spread over the high-temperature rolling strip, which leads to a fire of the equipment. When an on-line roll grinder is newly provided in the existing rolling equipment, there are problems in that spaces for installing equipment such as a pump, an oil tank, new pipings etc. are necessary. Furthermore, a long period of construction is needed because of securing the space for installing such equipment and pipings. Because a large quantity of oil is needed to rotate the hydraulic motor at a high speed, more electric power is needed to supply the oil than the case where the axis of the grinding wheel is turned directly by the electric motor. In the technology disclosed in Japanese Patent Laid-Open Print No 6-270059, while the precision for detecting a position of the mechanism for transferring the grinding wheel is considered, the rotary precision and the safety of the rotary mechanism of the grinding wheel are not considered.

There is another problem in applying the electric motor, not the hydraulic motor, to the grinding of the rolls. The reason of difficulty of using the electric motor for rotational driving of the grinding wheel is as follows. First, it has been thought that stable performance of the electric motor for a long time was difficult because the on-line roll grinder receives a thermal effect from a large quantity of cooling water for cooling the rolls and from the strip. Second, a large contact force between the rolls and the grinding wheel is needed to grind hard rolls as much as possible within a fixed time. As the contact force increases, the necessary rotary torque of the motor for driving the grinding wheel should be increased. As a result, an outer dimension of the electric motor becomes larger so as to generate a necessary rotary torque for satisfying the desired rotary torque. Since there are guides, etc. around the rolls in the rolling mill, it is difficult to install such a large sized motor to the on-line grinding equipment because the guides, etc. hinder the installment.

Consequently, the hydraulic motor has been used for the on-line roll grinding from viewpoints of the driving force, spaces, etc. In the conventional equipment, the length of the grinding device in a rotary axial direction was needed to be about 1000 mm or less to install in the rolling mill. The space length of about 200 to 300 mm in the rotary axial direction for the hydraulic motor, etc. was sufficient. When the electric motor is substituted simply for the hydraulic motor in considering the driving torque, the necessary space becomes 2 to 3 times the hydraulic motor case, and the length in the rotary axial direction becomes about 400 mm or more. Because the inside of the rolling mill equipped with the on-line grinding equipment is a very bad environment where rolling oil, cooling water and dust are scattered, the electric motor being easily influenced by the environment during operation can not be used. To use the electric motor for rotational driving of the grinding wheel, the defects in using the electric motor described in the prior art must be prevented. In the first place, a long service life of the electric motor must be secured by protecting it from a severe environment in the rolling mill such as heat from a large quantity of cooling water and the strip. Especially, the AC servo motor has semiconductor devices installed in an encoder that measures a revolution number of the motor at high precision. These semiconductor devices are particularly sensitive to humidity and temperature, and therefore, the environment must be maintained so that the semiconductor devices can operate normally. Secondly, the size of the electric motor that can generate rotary torque for grinding should be small.

SUMMARY OF THE INVENTION

An object of this invention is to provide an electric motor driven on-line roll grinder, a method of controlling the grinder and a method of grinding rolls that decreases dangers such as a fire of equipment, wherein a rotational driving of grinding wheel equipment of a grinding unit for grinding rolls of a rolling mill is an electric motor that can operate do operation for a long term.

The electric motor driven on-line roll grinder of this invention comprises a grinding unit for grinding the rolls in the rolling mill, and traverse equipment for moving a grinding unit in the axial direction of the rolls, wherein the grinding unit comprises a grinding wheel for grinding the rolls, a driving device for rotating the grinding wheel, and a grinding wheel transfer equipment for pressing the grinding wheel down on the rolls, characterized in that the driving device is the electric drive motor which is enclosed in a room so as to protect the motor from the environmental factors such as humidity, oil, dust, heat, etc. The room is constituted by a casing member which seals off the motor having semiconductor devices from the environment and heat from the strip and cooling water. The inside of the casing member is controlled to a desired temperature to protect the semiconductor devices.

The present invention provides a method for controlling the motor driven on-line roll grinder, which comprises cooling the inside of the room enclosing the electric motor having semiconductor devices to maintain a desired temperature.

Furthermore, the present invention provides a method for grinding the motor driven on-line roll grinder, which comprises grinding the rolls in the rolling mill, wherein the temperature of the inside of the room enclosing the electric motor having semiconductor devices is maintained at a desired temperature.

By the use of the electric drive motor as the driving device for rotating the grinding wheel of the plane type or the cup type of the on-line roll grinder installed in the rolling mill, a danger of a fire of the rolling equipment is prevented because there is no scattering of oil in the rolling mill from oil supply pipes of a hydraulic motor at the time of rolling accidents. Thus, the safety of the rolling mill is improved. By providing a controlling equipment for controlling the atmosphere in the room for the electric motor, the motor can be operated in a suitable atmosphere.

DETAILED DESCRIPTION OF PREFERRED EMBODIMENTS

Figure 1:
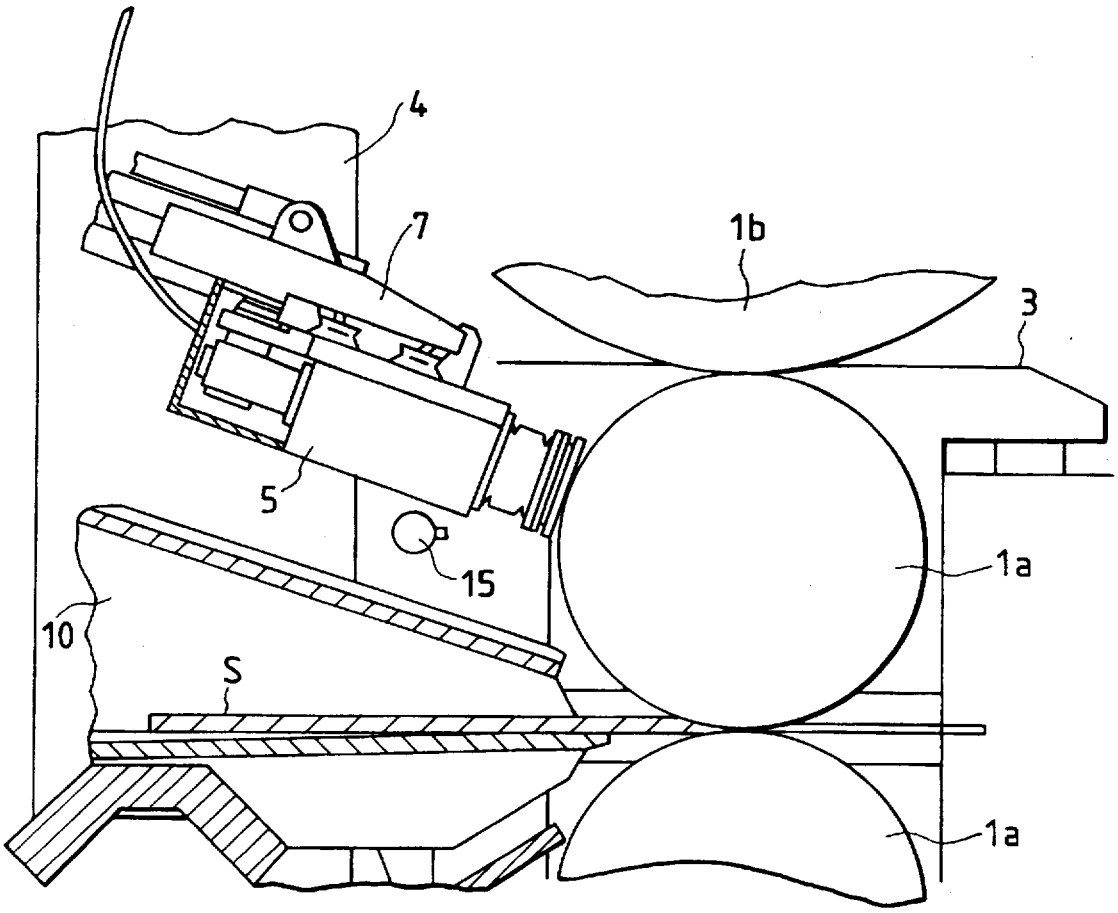
FIG. 1 is a cross sectional view of a main part of a rolling mill having a grinding unit of an electric motor driven on-line roll grinder for a rolling mill according to an example of this invention.

An example of this invention is explained below. In FIG. 1, the rolling mill of this example is a 4-high rolling mill which comprises a pair of work rolls 1*a* for rolling strip S and a pair of upper and lower back up rolls 1*b* each supporting each of work rolls 1*a*. Work rolls 1*a* are held by chocks 3. These chocks 3 are installed in stand 4, and entrance guide 10 is arranged to guide the strip S to work rolls 1*a* at the input side of the strip S. Coolant header 15 is provided for taking away the heat from rolls 1*a*, which occurs at the time of rolling, so that work rolls 1*a* are cooled at the time of rolling. An on-line roll grinding device of this example is provided at the rolling mill. The on-line roll grinding device usually comprises one or more grinding units 5 on each of the work rolls 1*a*. FIG. 1 explains that upper work roll 1*a* is provided with roll grinder unit 5, but lower work roll 1*a* is also provided with the same roll grinder unit 5.

Figure 2:
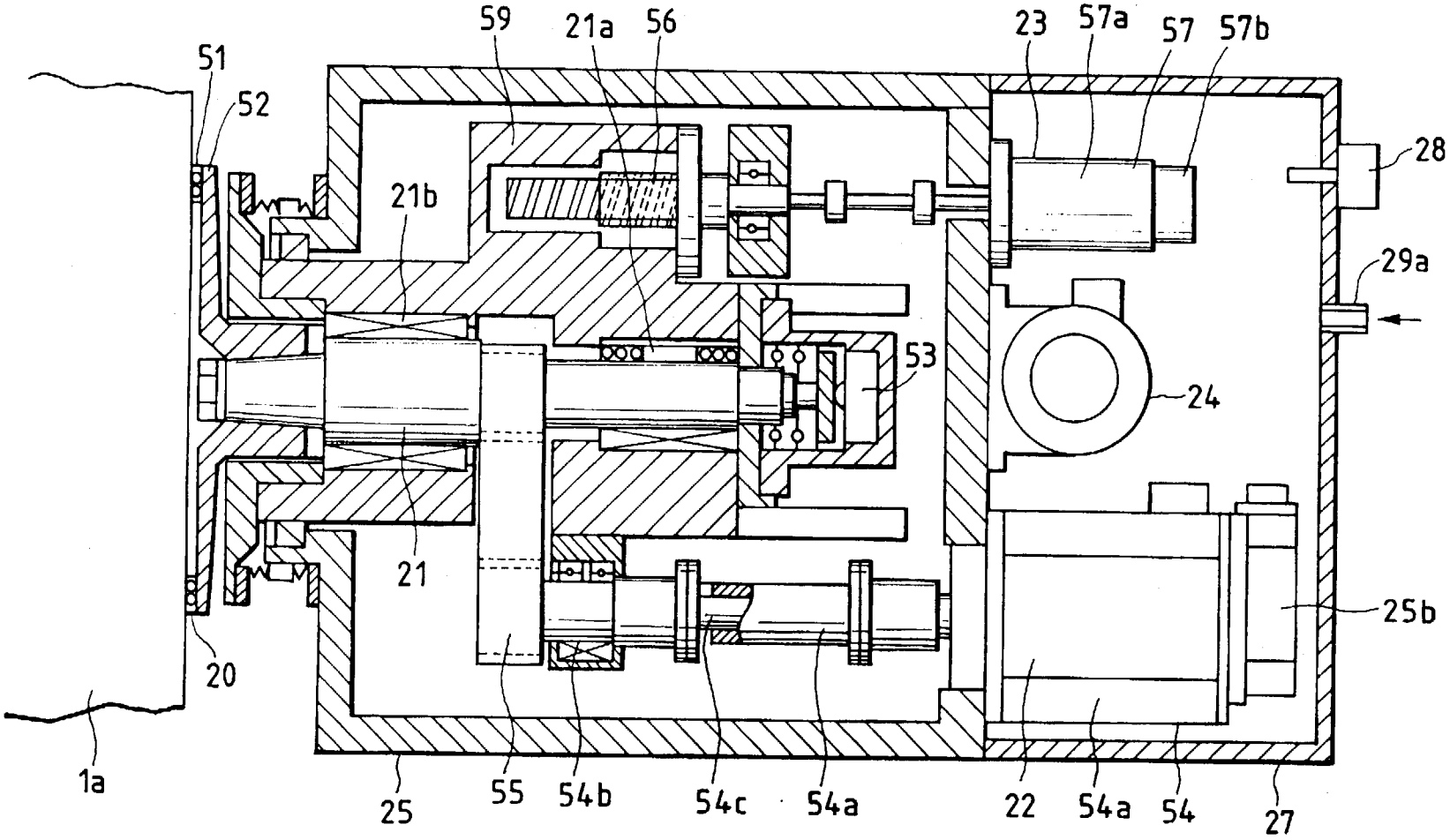
FIG. 2 is a horizontal cross sectional view of a grinding unit of an electric motor driven on-line roll grinder for a rolling mill according to an example of this invention.
Figure 3:
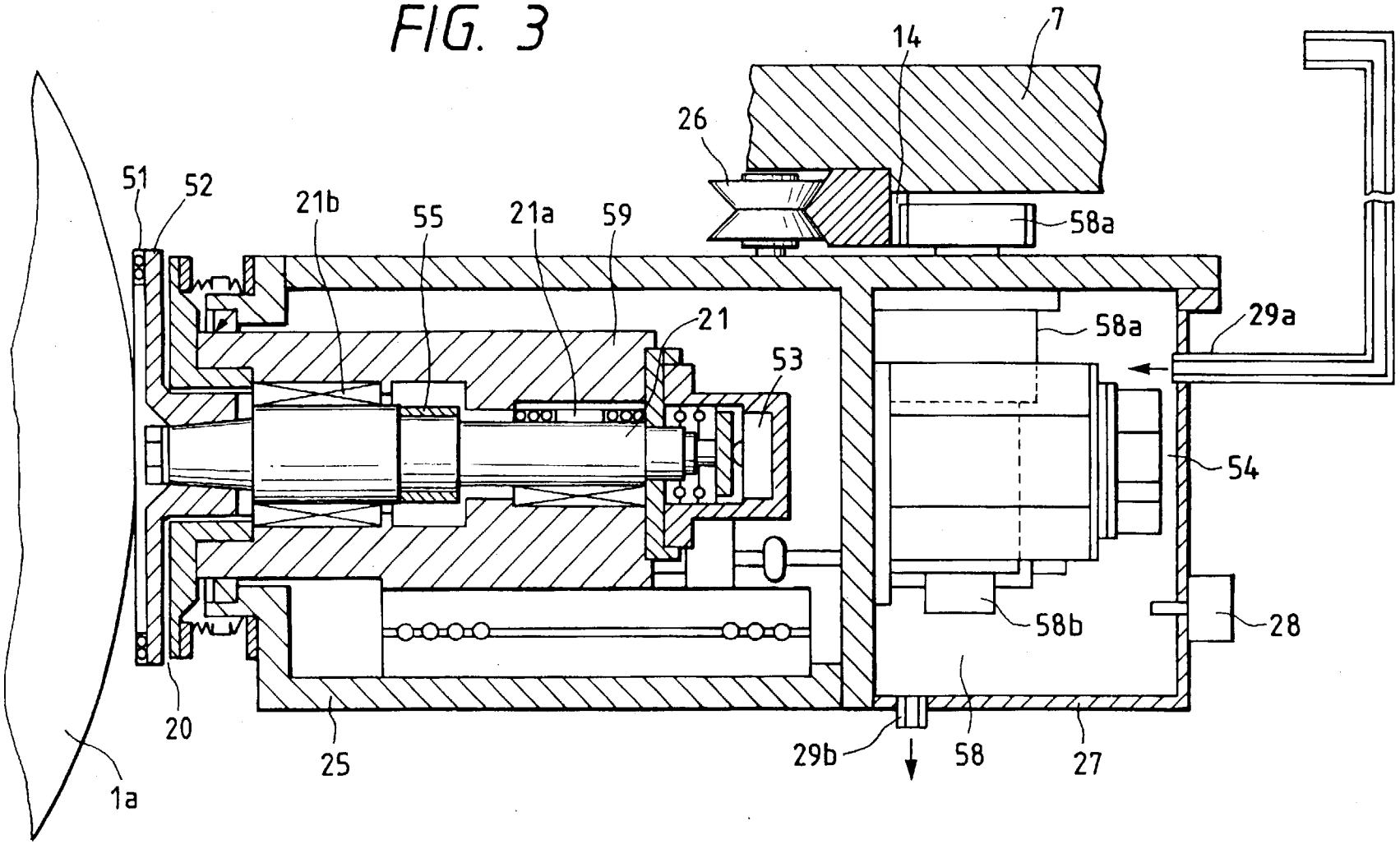
FIG. 3 is a vertical cross sectional view of the grinding unit of the above example.

Grinding unit 5 shown in FIG. 2 and FIG. 3 is composed of grinding wheel 20 of the plate type for grinding roll 1*a* (in place of the plate type wheel, a grinding wheel of a cup type can be used), grinding wheel driving device 22 for rotating grinding wheel 20 through rotation axle 21 of the grinding wheel, grinding wheel transfer equipment 23 that presses grinding wheel 20 to roll 1*a*, and grinding wheel moving equipment 14 for moving grinding wheel 20 in the axial direction of roll 1*a*. The rotation axle 21 of the grinding wheel is inclined by a small angle with respect to the right angle direction of roll axis in order to bring only one side of grinding wheel 20 into contact with roll 1*a*. Load cell 53 for measuring the contact force between grinding wheel 20 and roll 1*a* is disposed at the position opposite to the grinding wheel of grinding wheel axle 21. Grinding wheel axle 21 is supported by bearings 21*a* and 21*b* that can smoothly convey a load to load cell 53, while rotating. Grinding wheel driving device 22 comprises AC servo motor 54 for driving grinding wheel that rotatably drives to obtain a specified circumferential velocity of grinding wheel 20, and belt 55 for transmitting the rotation of AC servo motor 54 for driving the grinding wheel rotation axle 21 of the grinding wheel. As has been described above, by using the electric rotary driving mechanism, not the hydraulic type, a flexible hose for supplying oil is unnecessary, and therefore, there are no risks of damages to the flexible hose at the time of a rolling accident or scattering of oil.

Grinding wheel transfer equipment 23 comprises AC servo motor 57 for pushing the grinding wheel, and ball screw 56 that sends the grinding wheel axle 21 and load cell 53 to the front and the back together, wherein AC servo motor 57 for pushing the grinding wheel is composed of motor 57*a* for generating a rotating force and encoder 57*b* for detecting a turning angle. Grinding wheel axle 21 and load cell 53 are united and enclosed in body 59 so as to move together back and forth in grinding wheel transfer equipment 23. Equipment except for grinding wheel driving device 22 and AC servo motor 57 for pushing the grinding wheel are enclosed in case 25.

Figure 4:
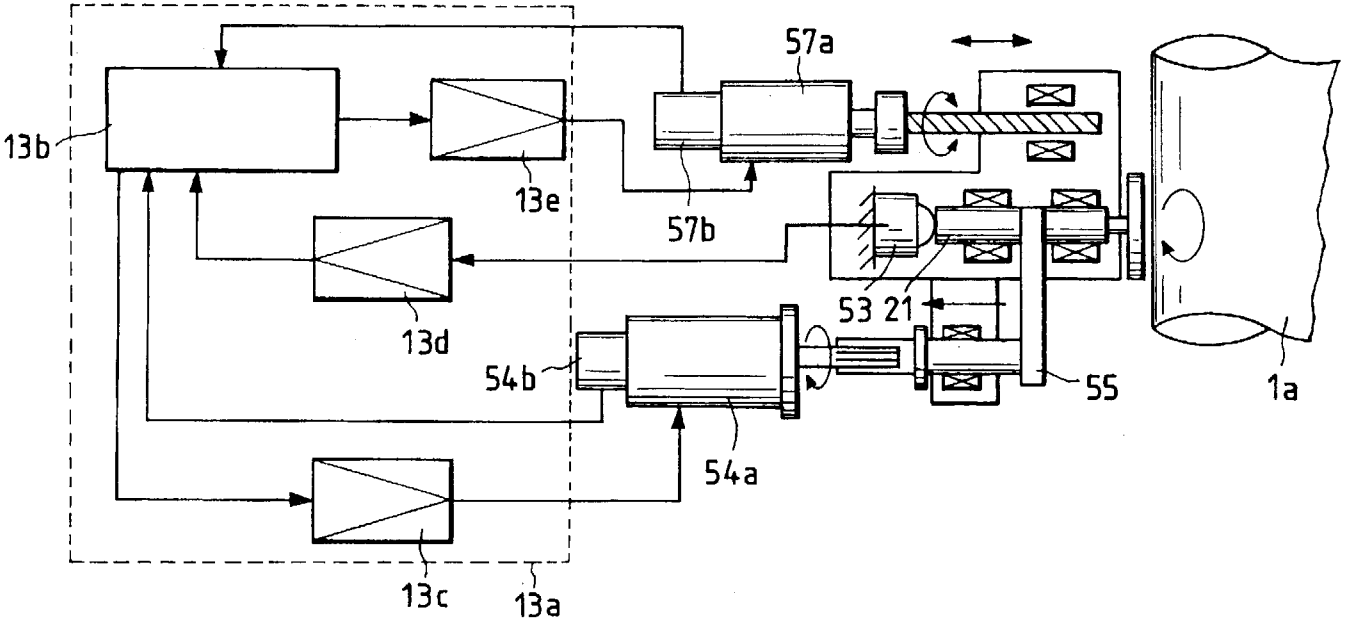
FIG. 4 is diagrams of control systems for grinding units of this invention.

A rotary axle 54*b* connects belt 55 and moves back and forth with body 59 servo motor 54 for driving the grinding wheel is fixed to case 25 and is connected with spline outer case 54*a* for axial sliding support of inner case 54*c* and axle 54*b*. The motors of grinding wheel driving device 22 and grinding wheel transfer equipment 23 are surrounded, enclosed and protected by cover 27 which is separated from case 25. Formed is a room for the driving device, which is separated from the environment by cover 27. As is shown in FIG. 3, grinding wheel movement equipment 24 facilitates smooth movement of the grinding wheel by engagement of AC servo motor 58 for moving the grinding wheel with pinion 58*a* installed in the rotary axis of AC servo motor 58 for moving the grinding wheel and rack 14. AC servo motor 58 for moving the grinding wheel comprises encoder 58*b* for detecting a number of revolutions. Grinding unit 5 is connected to slide rail 7 with wheel 26 so as to move in parallel with the center of the axle of roll 1*a*. Information from load cell 53, encoders 57*b* and 58*b* enters information processor 13*b* shown in FIG. 4 to calculate, and then signals are transmitted to AC servo motor 54 for driving the grinding wheel through driving amplifier 13*c* provided in control unit 13*a*. The signals of the rotating angle of the motor detected by encoder 57*b* of the grinding wheel transfer equipment is transmitted to information processor 13*b*. The signal of the rotary speed of the motor detected by encoder 54*b* of the rotary driving device of a grinding wheel is transmitted to information processor 13*b*. A position signal of the grinding wheel detected by load cell 53 is transmitted to information processor 13*b* through driving amplifier 13*d*. The control signal for controlling motors is sent from information processor 13*b*. The above control signals are sent to AC servo motor 54*a* through driving amplifier 13*c* and sent to AC servo motor 57*a* through driving amplifier 13*e*.

Figure 6:
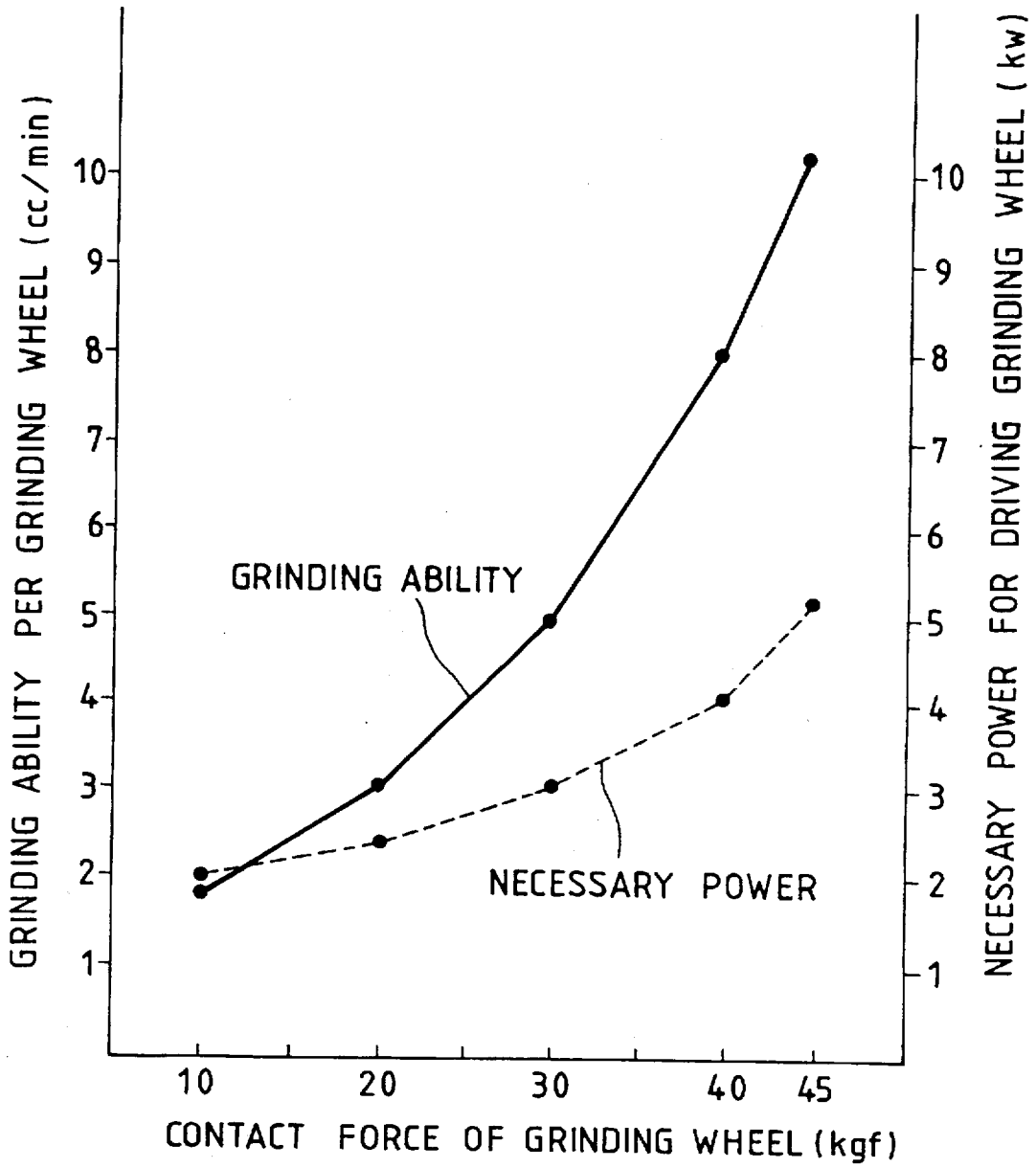
FIG. 6 shows a relation among a contact force of a grinding wheel, grinding ability and necessary driving force.

In the on-line roll grinder, a part of the roll, where a strip S does not pass, is removed by grinding the work roll with grinding wheel 20 to the same depth as the depth worn bypassing of strip S. In the case where roll 1*a* has a 800 mm in diameter and a 2000 mm in length and where strip S has a 600 mm in minimum width, the grinding ability necessary for grinding one coil is 7 cc/coil, wherein the ability is a number of a ground volume of the roll per one coil with the, proviso that 2 μm per roll is worn by rolling one coil 1. If the roll is ground by two grinding wheels 20, the grinding ability per one grinding wheel 20 is 3.5 cc/coil. When an effective grinding time within the time of grinding one coil is 45 sec., a necessary grinding ability per unit time is 4.67 cc/min. When a material of strip S like special steel is a harder one, a wear quantity of the work roll increases, and the necessary grinding ability per unit time becomes about double. FIG. 6 shows a test result of a relationship among the contact force of grinding wheel 20, the grinding ability, and the necessary power of a driving motor for the grinding wheel. The result was obtained using rotary grinding wheel 20 made of CBN grinder #120 consisting of cubic boron nitride, wherein the width of the grinder was 40 mm, a rotary speed was 1200 m/min, and a rotary speed of the roll was 600 m/min, a nickel grain roll was used as work roll 1*a*. A concentration of abrasive grain of CBN or a relative density with respect to that of BN should be in the range of 50 to 100, and the grain size of the abrasive grain of CBN should preferably be in the range of #80 to #180 as defined in Japanese Industrial Standards. From this test result, it is apparent that when the on-line roll grinder is provided with two grinding units 5 for each roll, the driving source of 2 kw or more for rotating the grinding wheel is optimum as a grinding power to obtain the grinding wheel ability in the range of 2 to 10 cc/min. Approximately 2 to 5.3 kw of a driving power source can be read from FIG. 6. That is, if this grinding power is in the range of about 2 to 6 kw, it is thought that the necessary grinding ability can be gained. Actually, a desirable grinding power is in the range of about 3 to 6 kw with a margin. The relationship between the contact force of grinding wheel and the necessary driving power in FIG. 6 is more accurate, compared with a conventional hydraulic motor. With regard to the conventional hydraulic motor, the relationship between the contact force of the grinding wheel and the driving power was not accurate due to a loss of oil pressure and a mechanical loss of a cylinder. The grinding device of this invention can detect malfunction by using the above relation. In other words, the required contact force predetermined based on the driving output power of the electric drive motor is set. The contact force of the grinding wheel is actually detected at the time of grinding.

Figure 7:
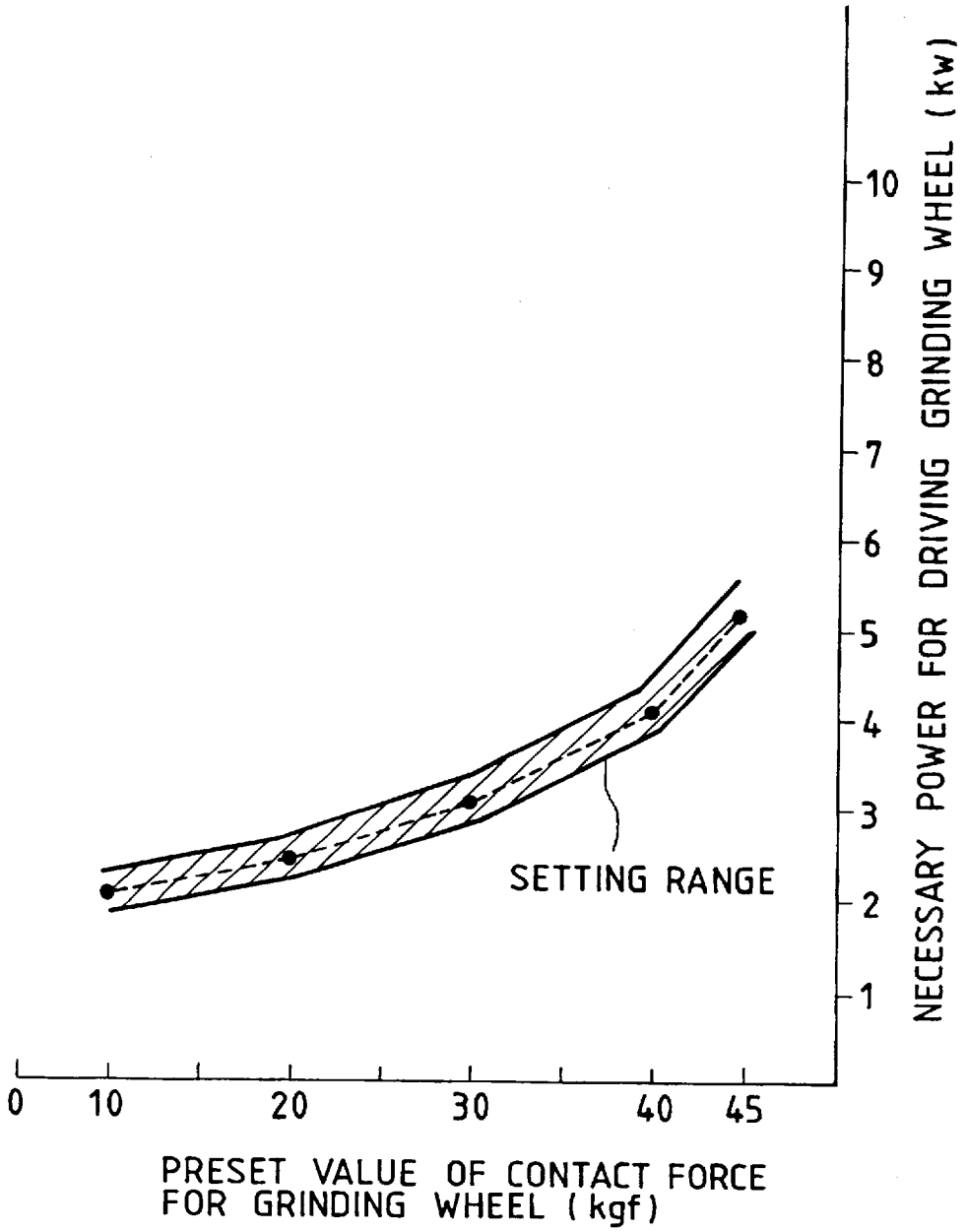
FIG. 7 shows preset values with respect to a contact force of a grinding wheel and necessary driving force.
Figure 8:
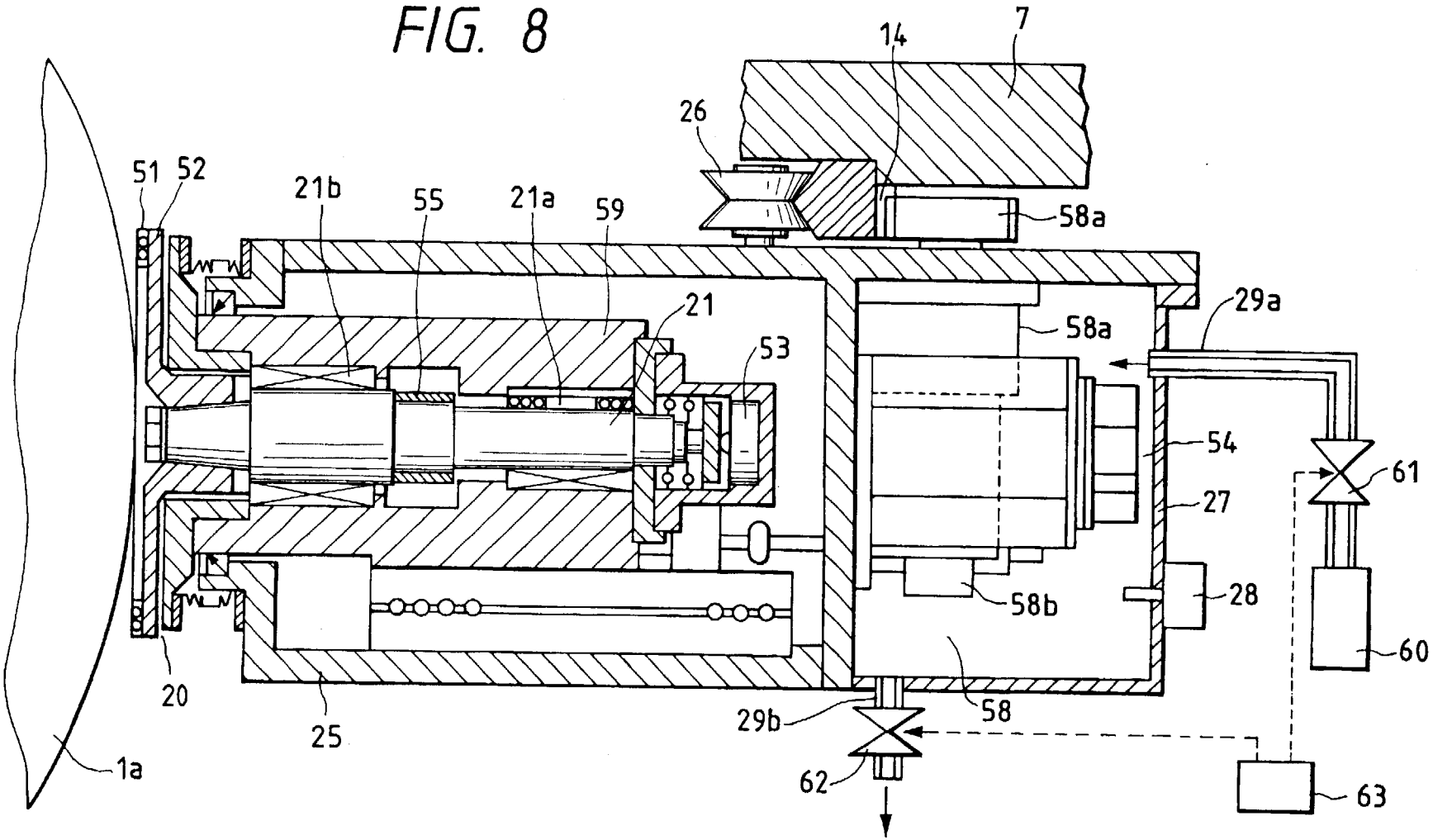
FIG. 8 is a vertical cross sectional view of the grinding unit of another example.

Comparing the relation between the detected contact force with the preset contact force, an alarm is generated, or grinding is stopped, or the detected contact force is adjusted to the preset contact force by sending a signal to AC servo motor 57 for pushing the grinding wheel to the work roll, when the detected contact force is different from the preset contact force. While the preset contact force is represented by the necessary power shown in FIG. 6, it is desirable to set the above contact force to a desired range in consideration of an error of several %. An example of the preset value X kw is shown in FIG. 7, wherein the preset value is set in the range of X±0.25 kw. When an actual value goes outside of this range, an abnormal grinding can be prevented by generating an alarm for informing abnormality, stopping the grinding wheel or adjusting the contact force.

Figure 9:
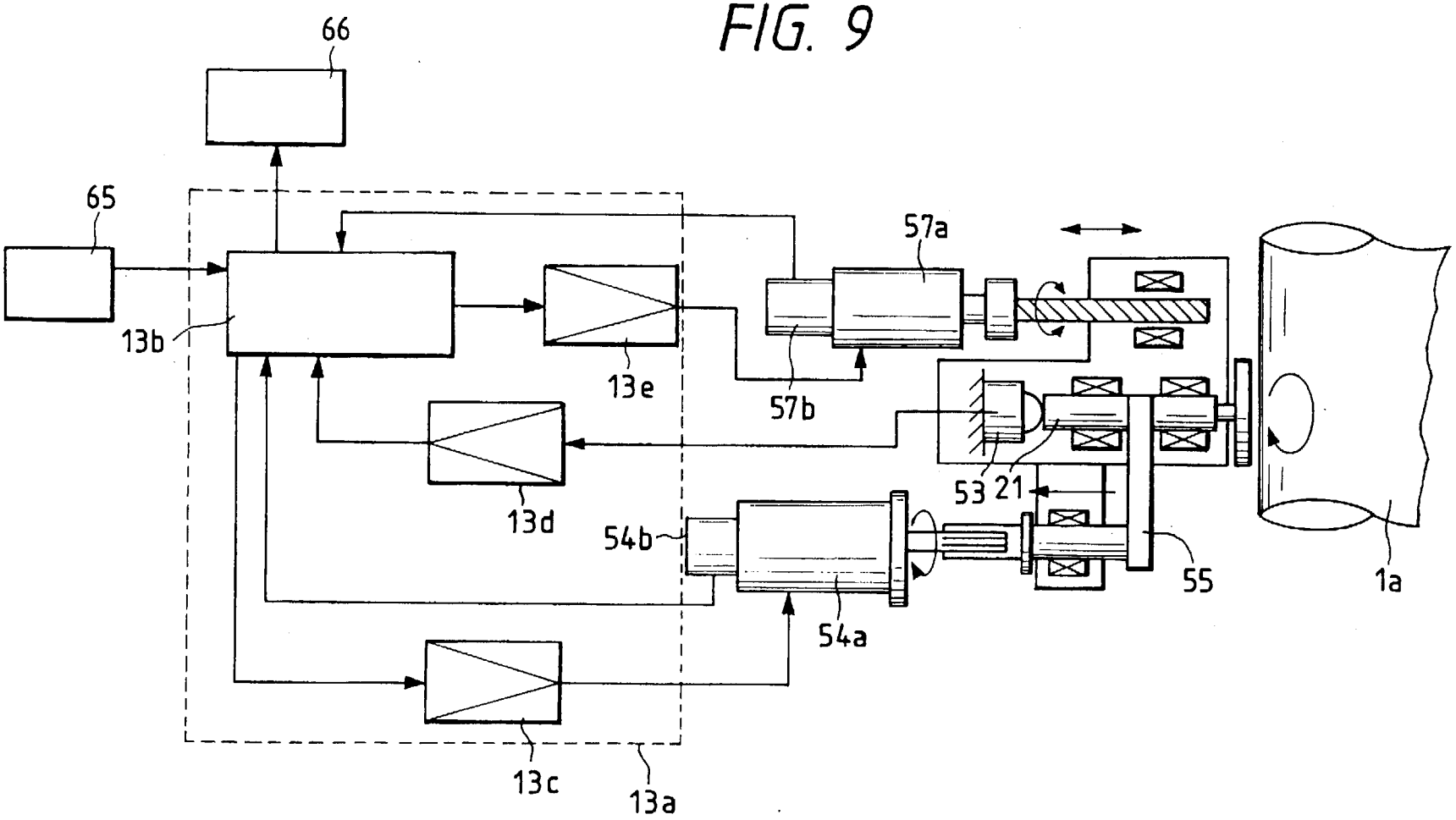
FIG. 9 is diagrams of control systems for the grinding units of the above example.

The preset range of FIG. 7 is set to contact force setting equipment 65 shown in FIG. 9. Then, the actual contact force can be detected by the position signal of the grinding wheel obtained through driving amplifier 13*d*. Then, the detected contact force and the preset value, which are set to contact force setting equipment 65, are taken into information processor 13*b*. Information processor 13*b* compares the detected contact force with the preset value, and when the detected contact force is within the preset range, the grinding is continued. In the case where the detected contact force falls outside the preset range, a signal is given to warning system 66, and the alarm is issued. By sending the signal to driving amplifier 13*c* or 13*e* for separating the grinding wheel from the work roll or for stopping the rotary drive, the grinding can be stopped. Otherwise, the actual contact force is adjusted to the preset contact force by sending the signal to AC servo motor 57 for pushing the grinding wheel. It is optimum to use AC servo motor 54 for driving the grinding wheel composed of a synchronous motor of the permanent magnet field type 54*a* and encoder 54*b* so that the driving force is generated continuously and the outer size is made as small as possible. In this structure, the rotary speed can be detected by the encoder, and the rotation of the AC servo motor can be controlled according to the detected value. The synchronous motor of the permanent magnet field type is small sized and can generate a large torque. Consequently, the outer size of the grinding device can be made small by using the synchronous motor of the permanent magnet field type.

Figure 5:
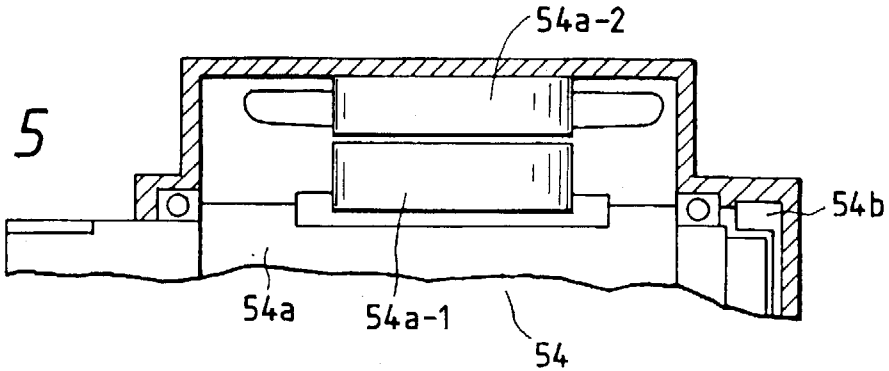
FIG. 5 is a vertical sectional view of a synchronous motor of the permanent magnet field type.

An outer size of a part enclosed in cover 27 in the rotary axial direction can be limited to about 200 to 300 mm, so that a small grinding device for generating a large torque can be obtained. In this example, the outer size of the whole grinding device in the rotary axial direction can be made about 1000 mm, and therefore, it is possible to make the grinding device with an improved grinding ability. As is shown in FIG. 5, this synchronism motor 54*a* of the permanent magnet field type is composed of stator 54*a*-2 for rotating rotor 54*a*-1 and rotor 54*a*-1 that are made of permanent magnet. The synchronism motor 54*a* is rotated by a three phase alternating current that flows in stator 54*a*-1. AC servo motor 54 for driving the grinding wheel is provided with encoder 54*b* disposed to synchronous motor 54*a* of the permanent magnet field type. The rotary speed of synchronous motor 54*a* of the permanent magnet field type is detected by encoder 54*b*, and the rotary speed is controlled by driving amplifier 13*c* to be a desired speed. When the rotary speed of the grinding wheel is desired to be changed under the various grinding conditions by using AC servo motor 54 for driving the grinding wheel, the rotary speed of the grinding wheel can be controlled optionally. However, electronic parts including semiconductor devices are installed in encoder 54*b* in order to detect the rotary speed of the motor with a high accuracy. The electronic parts including the semiconductor devices are sensitive to environment where electric parts are installed. Especially, the electronic parts do not work normally when humidity and a temperature exceed tolerance, and therefore, it is desirable to maintain an ambient temperature to 50° C. or less and circumferential humidity to 20 to 80%.

The on-line roll grinder is operated in a large amount of cooling water that is released from the header 15 for cooling work roll 1*a* consequently, etc. Therefore, grinding unit 5 is not heated to a high temperature by heat from the strip S. But, as the cooling water splashes on grinding unit 5, it is necessary for grinding unit 5 to seal as perfect as possible so as to prevent the water from entering in grinding unit 5. Even if grinding unit 5 is sealed perfectly, there remains a problem caused by the heat which is generated by continuous operation of AC servo motor 54 for driving the grinding wheel. Humidity in grinding unit 5 is increased by permeation of a gas containing the moisture from the slide sealing part, etc. by moving grinding wheel 20 back and forth. Therefore, means for adjusting the humidity is necessary. To keep the humidity in grinding unit 5, specially in the room for enclosing AC servo motor 54 to 20 to 80%, dried gas, such as air is introduced with a hose from the outside. To introduce the dried gas, inhalation hole 29*a* is prepared in cover 27. In order to always substitute the dried gas with new dried gas, emission hole 29*b* for emitting the dried gas is prepared in cover 27. In addition, valve 61 is provided to inhalation hole 29*a*. Dried air is sent to inhalation hole 29*a* through valve 61 from dry air unit 60 for controlling the humidity of the air flowing therein, and then, the dried air is released from emission hole 29*b*. As a result, humidity in cover 27 can be kept in the desired range. Therefore, the humidity in the room for driving device can be controlled to control the humidity to 20 to 50%. It is desirable to control the injection speed of dried air and the injection gas humidity by monitoring the humidity in the room with a hygrometer installed in the driving device. And, it is desirable to control the injection speed, the injection gas humidity and opening and closing of valve 61 of inhalation hole 29*a* and valve 62 of discharge hole 29*b*, etc. according to the pressure in the room by monitoring pressure in the room with a manometer installed to the driving device.

A seal is inserted into connecting part of grinding unit 5 in order to prevent the cooling water from permeating from entering the room, but there is a possibility that a small quantity of the cooling water enters into grinding unit 5 from the part of the seal in the long term. Even if a small quantity of the cooling water enters into grinding unit 5, especially into cover 27 for enclosing AC servo motor 54, the cooling water which is permeated from the outside together with the dried gas is released from emission hole 29*b* by providing emission hole 29*b* in the lower part of grinding unit 5 or cover 27. Therefore, the cooling water does not stay inside. In this case, it is desirable that emission hole 29*b* is installed at the lowest position in the vertical direction. In addition, by maintaining the pressure of the gas in the room of cover 27 enclosing grinding unit 5 or AC servo motor 54 to be higher than the atmospheric pressure, the cooling water becomes mist in the gas released from emission hole 29*b* and is smoothly discharged even if cooling water stays in the room. 3 to 5 mm is fine for the diameter of the opening of emission hole 29*b*, and it is desirable to keep the pressure of the gas to be double the atmospheric pressure. Concretely, the pressure of the gas should preferably be 1.5 to 2.5 times the atmospheric pressure. By providing valve 62 to emission hole 29*b* to control opening and closing valve 61 of inhalation hole 29*a* and valve 62 of emission hole 29*b* with control means 63, the internal pressure can be controlled effectively.

The room for the driving device in which AC servo motor 54 is enclosed can be cut off from the environment of the cooling water with cover 27 made of a metal plate. As for cover 27, the metal plate is made of a material free from corrosion in the water and good heat conductivity such as thin plate of stainless steel or aluminum. The temperature of the room in cover 27 for enclosing AC servo motor 54 is increased by the heat energy released from AC servo motor 54 during its operation. It is difficult to dissipate all the heat energy released into the room only by the circulation of the gas introduced from release hole 29*a*. When cover 27 is made of thin plate of stainless steel or aluminum with good heat conductivity, the heat energy released from AC servo motor 54 is removed effectively by roll cooling water that splashes on cover 27, and the inner temperature of the room can be kept to 50° C. or lower.

In the above, the dried gas plays a very important role in maintaining a high performance of AC servo motor 54 in the severe environment of the rolling mill. This dried gas may cause a trouble in AC servo motor 54 when a proper state of the dried gas is not maintained by operation fault or an equipment trouble. To prevent the above mentioned problem, when the pressure of the gas in grinding unit 5 becomes lower than a predetermined value, pressure sensor 28, for monitoring the pressure of the gas and for warning of the abnormality of equipment is disposed at a place where the atmospheric pressure of the room of the driving device where AC servo motor is enclosed, or at a place near grinding unit 5 of the piping for sending the gas. Normally, the signal is sent to information processor 13*b* from pressure sensor 28, and when the abnormality is recognized, a suitable counter measure such as stopping the grinding, etc. can be taken so that the equipment trouble does not spread further.

In this example as mentioned above, since the roll grinder unit is constructed so that all the equipment's such as the grinding wheel driving device, the grinding wheel transfer equipment and the actuator of the grinding wheel movement equipment are operated by electric driving, supplying of the pressurized oil to the roll grinder unit is unnecessary. Therefore, there is no necessity of installing a flexible hose that supplies pressurized oil to the roll grinder unit. Because the hose is not used, there is no troubles that hot strip is bitten between the work rolls at the time of a rolling accident, or the strip breaks the hydraulic flexible hose. Therefore, there is no danger of the equipment fire by scattering the high pressurized oil in the flexible hose. By always protecting the AC servo motor in the dried gas, it can operate for a long time in the very severe environment of the rolling mill. By using the AC servo motor system, the optimum rotary speed of the grinding wheel can be easily controlled even if a grinding load changes.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electric motor driven on-line roll grinder of the grinding wheel type, which comprises a grinding unit for grinding a work roll in a rolling mill, a traverse equipment for moving said grinding unit in the axial direction of said work roll, said grinding unit comprising a grinding wheel for grinding said work roll, a driving device for rotating said grinding wheel through an axle of said grinding wheel and a grinding wheel transfer equipment for pressing said grinding wheel on said work roll, wherein said electric motor driven on-line roll grinder further comprises, a driving device including an electric drive motor for rotatably driving said grinding wheel;

a casing for forming room for driving device, said motor being enclosed in said casing; and humidity control means for controlling humidity in said room for said driving device.

2. The electric motor driven on-line roll grinder according to claim 1, wherein said electric drive motor is a synchronous motor of a permanent magnet field type; and said grinding wheel is made of cubic boron nitride.

3. The electric motor driven on-line roll grinder according to claim 1, wherein said electric drive motor is an AC servo motor which is composed of said synchronous motor and an encoder, and rotary speed control means for controlling said rotary speed of said AC servo motor in accordance with a signal from said encoder.

4. The electric motor driven on-line roll grinder according to claim 3, wherein the electric motor driven on-line roll grinder comprises gas introducing means for introducing dried gas into said room, whereby the humidity is controlled to a humidity range is said room for the driving device of said grinding unit in which said AC servo motor is arranged.

5. The electric motor driven on-line roll grinder according to claim 3, which further comprises pressure adjustment means for controlling the pressure in said room for said driving device.

6. The electric motor driven on-line roll grinder according to claim 3, which further comprises means for generating an alarm, when the gas pressure in said grinding unit is lowered to a prescribed value or less.

7. The electric motor driven on-line roll grinder according to claim 3, which further comprises means for stopping grinding, when the gas pressure in said grinding unit is lowered to a prescribed value or less.

8. The electric motor driven on-line roll grinder according to claim 1, wherein said electric drive motor has a driving output power of 2 kw or more.

9. The electric motor driven on-line roll grinder according to claim 1, wherein said electric drive motor has a driving output power of 3 to 6 kw.

10. The electric motor driven on-line roll grinder according to claim 1, which further comprises detecting means for detecting a contact force of said grinding wheel with said work roll.

11. The electric motor driven on-line roll grinder according to claim 1, which further comprises detecting means for detecting a contact force of said grinding wheel with said work roll, comparison means for comparing the power between a contact force set on the basis of the driving output power of said electric drive motor and the detected contact force, and means for giving an alarm when said detected contact force is different from a prescribed contact force.

12. The electric motor driven on-line roll grinder according to claim 1, which further comprises detecting means for detecting a contact force of said grinding wheel with said work roll, comparison means for comparing the power between a contact force set on the basis of the driving output power of said electric drive motor and the detected contact force, and means for stopping grinding when said detected contact force is different from a prescribed contact force.

13. An electric motor driven on-line roll grinder comprising a grinding unit for grinding a work roll in a rolling mill, a traverse equipment for moving said grinding unit in the axial direction of said work roll, said grinding unit being composed of a grinding wheel for grinding said work roll, a driving device for rotating said grinding wheel by means of a rotation axle of said grinding wheel and a grinding wheel pushing equipment for pressing said grinding wheel to said work roll, wherein said electric motor driven on-line roll grinder is composed of a driving device comprising an electric drive motor for rotatably driving said grinding wheel, and wherein a room for surrounding said electric drive motor is formed by a casing, which further comprises humidity control means for controlling humidity in the room.

14. A method for controlling an electric motor driven on-line roll grinder comprising a grinding unit having a grinding wheel, operably disposed in a rolling mill having at least a pair of work rolls, a traverse device connected to said grinding unit, said grinding wheel being rotatably connected to a driving device having a motor, a casing enclosing said motor, a transfer device connected to said grinding wheel, whereby said grinding wheel is pressed to said work roll, which comprises controlling a pressure in said casing.

15. The method for controlling the on-line roll grinder having the electric motor driven grinding wheel according to claim 14;

wherein a prescribed contact force is set on the basis of the driving output power of said electric driving motor, wherein said contact force of grinding wheel is detected, and the detected contact force and the prescribed contact force are compared contact force, and then when said detected contact force is different from said prescribed contact force, an alarm is given or grinding is stopped.

16. The method for controlling the on-line roll grinder of the electric motor driven grinding wheel type according to claim 15;

wherein the contact force is controlled by said grinding wheel pushing equipment to the prescribed contact force.

17. The method for controlling the electric motor driven on-line roll according to claim 14, which further comprises controlling a humidity and temperature in said casing.

18. The method for controlling the electric motor driven on-line roll grinder according to claim 14, wherein said casing made of steel is cooled by cooling water for said work roll.

19. The method for controlling the electric motor driven on-line roll grinder according to claim 14, wherein the pressure in said casing is controlled to a pressure higher than the atmospheric pressure by introducing dried gas thereinto.

20. The method for controlling the electric motor driven on-line roll grinder according to claim 19, wherein the pressure in said casing controlled is to a pressure higher than the atmospheric pressure by discharging the gas from an outlet formed in said casing.

21. A method for operating an on-line roll grinder having an electric motor driven grinding wheel comprising a grinding unit for grinding a work roll in a rolling mill, a traverse equipment for moving said grinding unit in the axial direction of said roll, a grinding wheel for grinding said work roll, a driving device for rotating said grinding wheel, a grinding wheel pushing equipment for pressing said grinding wheel to said work roll, wherein said on-line roll grinder is composed of a driving device having an electric driving motor for rotatably driving said grinding wheel; and a casing for enclosing at least said motor of said driving device; which comprises controlling at least one of the humidity, temperature and pressure in said casing to a desired range during grinding.

22. An electric motor driven on-line roll grinder of the grinding wheel type, which comprises a grinding unit disposed in a rolling mill, a grinding unit transverser, said grinding unit comprising a grinding wheel, a driving device rotatably connected to said grinding wheel, and a grinding wheel transfer equipment, wherein said electric motor driven on-line roll grinder further comprises;

electric drive motor rotatably connected to said grinding wheel, casing surrounding and enclosing said electric drive motor, and a humidity control device.

23. An-on-line grinder having an electric motor driven grinding wheel comprising a grinding unit for grinding a work roll in a rolling mill, a traverse equipment for moving said grinding unit in the axial direction of said roll, a grinding wheel for grinding said work roll, a driving device for rotating said grinding wheel, and a grinding wheel pushing equipment for pressing said grinding wheel to said work roll, wherein said driving device has an electric driving motor for rotatably driving said grinding wheel; and a casing for enclosing said electric driving motor of said driving device, further comprising an environmental control unit for controlling the environment inside said casing.

24. An-on-line roll grinder according to claim 23, wherein said casing is configured to form a room for the electric driving motor which is sealed with respect to the environment of the grinding wheel and work roll during grinding operations to thereby protect the electric motor.

25. An on-line roll grinder according to claim 23, wherein said environmental control unit includes a humidifier.

26. An on-line roll grinder according to claim 23, wherein said environmental control unit includes a pressure introducing mechanism for increasing the pressure in said casing to above local atmospheric pressure.

27. An electric motor driven on-line roll grinder assembly for grinding a work roll in a rolling mill, comprising:

a grinding wheel for grinding said work roll, an electric motor drivingly connected to the grinding wheel, and a casing forming a room for the electric drive motor which is substantially sealed with respect to the grinding wheel environment during roll grinding operations, further comprising an environmental controller controlling the atmospheric conditions in the casing to be different than the atmospheric conditions surrounding the grinding wheel during grinding operations.

28. Anon-line roll grinder according to claim 27, wherein said environmental control unit includes a humidifier.

29. An on-line roll grinder according to claim 27, wherein said environmental control unit includes a pressure introducing mechanism for increasing the pressure in said casing to above local atmospheric pressure.

* * * * *